US009050498B2

(12) United States Patent
Lu et al.

(10) Patent No.: US 9,050,498 B2
(45) Date of Patent: Jun. 9, 2015

(54) EXERCISE ASSEMBLIES HAVING FOOT PEDAL MEMBERS THAT ARE MOVABLE ALONG USER DEFINED PATHS

(71) Applicant: Brunswick Corporation, Lake Forest, IL (US)

(72) Inventors: Zhi Lu, Glenview, IL (US); Gary Scott Clayton, Wheaton, IL (US); Mark C. Termion, Winfield, IL (US)

(73) Assignee: Brunswick Corporation, Lake Forest, IL (US)

( * ) Notice: Subject to any disclaimer, the term of this patent is extended or adjusted under 35 U.S.C. 154(b) by 86 days.

(21) Appl. No.: 13/783,610

(22) Filed: Mar. 4, 2013

(65) Prior Publication Data

US 2014/0248998 A1 Sep. 4, 2014

(51) Int. Cl.

| | |
|---|---|
| ***A63B 22/00*** | (2006.01) |
| ***A63B 71/00*** | (2006.01) |
| ***A63B 22/04*** | (2006.01) |

(Continued)

(52) U.S. Cl.

CPC ..... *A63B 21/154* (2013.01); *A63B 22/001* (2013.01); *A63B 22/0664* (2013.01); *A63B 2022/0682* (2013.01)

(58) Field of Classification Search

CPC .. A63B 22/00; A63B 22/001; A63B 22/0015; A63B 22/20; A63B 22/201; A63B 22/203; A63B 22/208

USPC ..... 482/51–54, 57

See application file for complete search history.

(56) References Cited

U.S. PATENT DOCUMENTS

| | | | |
|---|---|---|---|
| 321,388 | A | 6/1885 | Ruebsam |
| 652,612 | A | 6/1900 | Harrison |
| 663,486 | A | 12/1900 | Boren |

(Continued)

FOREIGN PATENT DOCUMENTS

| | | |
|---|---|---|
| CA | 2064657 | 10/1993 |
| DE | 83466 | 4/1895 |

(Continued)

OTHER PUBLICATIONS

International Search Report and Written Opinion, PCT/US2014/013821, mailed May 21, 2014.

(Continued)

*Primary Examiner* — Stephen Crow
*Assistant Examiner* — Garrett Atkinson
(74) *Attorney, Agent, or Firm* — Andrus Intellectual Property Law, LLP

(57) ABSTRACT

An exercise assembly comprises a frame and elongated foot pedal members that are each movable along user-defined paths of differing dimensions. Each foot pedal member has a from portion and a rear portion. Footpads are disposed on the rear portion of one of the pair of foot pedal members. Elongated coupler arms have a lower portion and an upper portion that is pivotally connected to the frame. Crank members have a first portion that is pivotally connected to the front portion of one of the pan of foot pedal members and have a second portion that is pivotally connected to the lower portion of one of the pair of coupler arms, such that each crank member is rotatable in a circular path. Elongated rocker arms have a lower portion that is pivotally connected to one of the pair of foot pedal members in between the foot pad and the crank member and have an upper portion that is pivotally connected to the frame.

31 Claims, 8 Drawing Sheets

(51) Int. Cl.

| | |
|---|---|
| ***A63B 21/00*** | (2006.01) |
| ***A63B 22/06*** | (2006.01) |

(56) References Cited

U.S. PATENT DOCUMENTS

| | | | | |
|---|---|---|---|---|
| 881,521 | A | | 3/1908 | Wilson |
| 931,394 | A | | 8/1909 | Day |
| 1,020,777 | A | | 3/1912 | Peterson |
| 1,715,870 | A | | 6/1929 | Spain |
| 1,850,530 | A | | 3/1932 | Brown |
| 1,902,694 | A | | 3/1933 | Edwards |
| 1,928,089 | A | | 9/1933 | Blickman |
| 1,973,945 | A | | 9/1934 | Chavin et al. |
| 2,453,771 | A | | 11/1948 | White et al. |
| 2,648,330 | A | | 8/1953 | Clark |
| 2,855,200 | A | | 10/1958 | Blickman |
| 3,127,171 | A | | 3/1964 | Noland et al. |
| D207,541 | S | | 5/1967 | Hesen |
| 3,378,259 | A | | 4/1968 | Kupchinski |
| D211,801 | S | | 7/1968 | Quinton |
| 3,444,830 | A | | 5/1969 | Doetsch |
| 3,563,541 | A | | 2/1971 | Sanquist |
| 3,586,322 | A | | 6/1971 | Kverneland |
| 3,589,715 | A | | 6/1971 | Mark |
| 3,614,097 | A | | 10/1971 | Blickman |
| 3,642,279 | A | | 2/1972 | Cutter |
| 3,659,845 | A | | 5/1972 | Quinton |
| 3,731,917 | A | | 5/1973 | Townsend |
| 3,741,538 | A | | 6/1973 | Lewis et al. |
| 3,745,990 | A | | 7/1973 | Neis |
| 3,756,595 | A | | 9/1973 | Hague |
| 3,758,111 | A | | 9/1973 | Agamian |
| 3,824,993 | A | | 7/1974 | Grant |
| 3,874,657 | A | | 4/1975 | Niebojewski |
| 3,918,710 | A | | 11/1975 | Niebojewski |
| 3,966,201 | A | | 6/1976 | Mester |
| 4,026,545 | A | | 5/1977 | Schonenberger |
| 4,066,257 | A | | 1/1978 | Moller |
| 4,185,622 | A | | 1/1980 | Swenson |
| 4,235,437 | A | | 11/1980 | Ruis et al. |
| 4,248,476 | A | | 2/1981 | Phelps |
| 4,300,761 | A | | 11/1981 | Howard |
| 4,383,714 | A | | 5/1983 | Ishida |
| 4,422,635 | A | | 12/1983 | Herod et al. |
| 4,436,097 | A | | 3/1984 | Cunningham |
| 4,519,604 | A | | 5/1985 | Arzounian |
| 4,576,377 | A | | 3/1986 | Wolff |
| 4,625,962 | A | | 12/1986 | Street |
| 4,664,646 | A | | 5/1987 | Rorabaugh |
| 4,666,173 | A | | 5/1987 | Graham |
| 4,679,787 | A | | 7/1987 | Guilbault |
| 4,757,987 | A | | 7/1988 | Allemand |
| 4,786,050 | A | | 11/1988 | Geschwender |
| 4,805,901 | A | | 2/1989 | Kulick |
| 4,826,153 | A | | 5/1989 | Schalip |
| 4,842,269 | A | | 6/1989 | Huang |
| 4,846,156 | A | | 7/1989 | Kopnicky |
| 4,872,669 | A | | 10/1989 | Henry |
| 4,881,732 | A | | 11/1989 | Kepiro |
| 4,905,330 | A | | 3/1990 | Jacobs |
| 4,913,396 | A | | 4/1990 | Dalebout et al. |
| 4,913,423 | A | | 4/1990 | Farran et al. |
| 4,921,247 | A | | 5/1990 | Sterling |
| 4,938,474 | A | | 7/1990 | Sweeney et al. |
| 4,974,831 | A | | 12/1990 | Dunham |
| 4,998,725 | A | | 3/1991 | Watterson et al. |
| 5,002,271 | A | | 3/1991 | Gonzales |
| 5,029,801 | A | | 7/1991 | Dalebout et al. |
| 5,058,881 | A | | 10/1991 | Measom |
| 5,102,380 | A | | 4/1992 | Jacobson et al. |
| 5,108,092 | A | | 4/1992 | Hurst |
| 5,109,778 | A | | 5/1992 | Berkowitz et al. |
| 5,110,117 | A | | 5/1992 | Fisher et al. |
| 5,121,654 | A | | 6/1992 | Fasce |
| 5,184,988 | A | | 2/1993 | Dunham |
| 5,186,697 | A | | 2/1993 | Rennex |
| 5,192,255 | A | | 3/1993 | Dalebout et al. |
| 5,199,931 | A | | 4/1993 | Easley et al. |
| 5,207,622 | A | | 5/1993 | Wilkinson et al. |
| 5,207,628 | A | | 5/1993 | Graham |
| 5,242,343 | A | | 9/1993 | Miller |
| 5,279,529 | A | | 1/1994 | Eschenbach |
| 5,282,776 | A | | 2/1994 | Dalebout |
| 5,295,928 | A | | 3/1994 | Rennex |
| 5,299,992 | A | | 4/1994 | Wilkinson |
| 5,352,167 | A | | 10/1994 | Ulicny |
| 5,352,169 | A | | 10/1994 | Eschenbach |
| 5,372,559 | A | | 12/1994 | Dalebout et al. |
| 5,383,829 | A | | 1/1995 | Miller |
| 5,423,729 | A | | 6/1995 | Eschenbach |
| 5,429,563 | A | | 7/1995 | Engel et al. |
| 5,441,467 | A | | 8/1995 | Stevens |
| 5,452,910 | A | | 9/1995 | Harris |
| 5,453,066 | A | | 9/1995 | Richter, Jr. |
| 5,518,473 | A | | 5/1996 | Miller |
| 5,529,554 | A | | 6/1996 | Eschenbach |
| 5,529,555 | A | | 6/1996 | Rodgers, Jr. |
| 5,536,225 | A | | 7/1996 | Neuberg et al. |
| 5,540,637 | A | | 7/1996 | Rodgers, Jr. |
| 5,549,526 | A | | 8/1996 | Rodgers, Jr. |
| 5,562,574 | A | | 10/1996 | Miller |
| 5,573,480 | A | | 11/1996 | Rodgers, Jr. |
| 5,577,985 | A | * | 11/1996 | Miller ..... 482/52 |
| 5,611,756 | A | * | 3/1997 | Miller ..... 482/52 |
| 5,616,111 | A | | 4/1997 | Randolph |
| 5,626,538 | A | | 5/1997 | Dalebout et al. |
| 5,637,058 | A | | 6/1997 | Rodgers, Jr. |
| 5,692,994 | A | | 12/1997 | Eschenbach |
| 5,735,774 | A | * | 4/1998 | Maresh ..... 482/57 |
| 5,879,271 | A | | 3/1999 | Stearns et al. |
| 5,893,820 | A | | 4/1999 | Maresh et al. |
| 5,895,339 | A | * | 4/1999 | Maresh ..... 482/51 |
| 5,935,046 | A | | 8/1999 | Maresh |
| 5,947,872 | A | | 9/1999 | Ryan et al. |
| 6,042,515 | A | | 3/2000 | Wang |
| 6,045,487 | A | | 4/2000 | Miller |
| 6,084,325 | A | | 7/2000 | Hsu |
| 6,110,076 | A | | 8/2000 | Hurt |
| 6,135,925 | A | | 10/2000 | Liu |
| 6,142,915 | A | * | 11/2000 | Eschenbach ..... 482/52 |
| 6,168,552 | B1 | | 1/2001 | Eschenbach |
| 6,183,397 | B1 | | 2/2001 | Stearns et al. |
| 6,183,398 | B1 | | 2/2001 | Rufino et al. |
| 6,206,804 | B1 | | 3/2001 | Maresh |
| 6,206,806 | B1 | | 3/2001 | Chu |
| 6,248,044 | B1 | * | 6/2001 | Stearns et al. ..... 482/52 |
| 6,390,953 | B1 | * | 5/2002 | Maresh et al. ..... 482/52 |
| 6,482,132 | B2 | | 11/2002 | Eschenbach |
| 6,544,146 | B1 | | 4/2003 | Stearns et al. |
| 6,648,800 | B2 | * | 11/2003 | Stearns et al. ..... 482/52 |
| 6,689,020 | B2 | * | 2/2004 | Stearns et al. ..... 482/52 |
| 6,846,273 | B1 | * | 1/2005 | Stearns et al. ..... 482/52 |
| 6,855,093 | B2 | * | 2/2005 | Anderson et al. ..... 482/52 |
| RE38,803 | E | | 9/2005 | Rodgers, Jr. |
| 7,060,005 | B2 | * | 6/2006 | Carlsen et al. ..... 482/52 |
| 7,112,161 | B2 | | 9/2006 | Maresh |
| 7,153,239 | B1 | | 12/2006 | Stearns et al. |
| 7,175,568 | B2 | * | 2/2007 | Eschenbach ..... 482/52 |
| 7,344,480 | B2 | | 3/2008 | Maresh et al. |
| 7,479,093 | B1 | | 1/2009 | Immordino et al. |
| 7,485,072 | B2 | * | 2/2009 | Chuang et al. ..... 482/52 |
| 7,494,447 | B2 | * | 2/2009 | Eschenbach ..... 482/52 |
| 7,520,839 | B2 | * | 4/2009 | Rodgers, Jr. ..... 482/52 |
| 7,530,926 | B2 | * | 5/2009 | Rodgers, Jr. ..... 482/52 |
| 7,625,317 | B2 | | 12/2009 | Stevenson et al. |
| 7,682,288 | B1 | | 3/2010 | Stearns et al. |
| 7,717,833 | B1 | | 5/2010 | Nelson et al. |
| 7,771,324 | B2 | | 8/2010 | Anderson et al. |
| 7,828,698 | B2 | | 11/2010 | Rodgers, Jr. |
| 7,841,968 | B1 | * | 11/2010 | Eschenbach ..... 482/52 |
| 7,887,465 | B2 | * | 2/2011 | Uffelman ..... 482/52 |
| 7,918,766 | B2 | * | 4/2011 | Lu et al. ..... 482/52 |
| 7,931,566 | B1 | | 4/2011 | Radke et al. |
| 8,105,213 | B2 | * | 1/2012 | Stewart et al. ..... 482/52 |

(56) References Cited

U.S. PATENT DOCUMENTS

| | | | | |
|---|---|---|---|---|
| 8,272,997 | B2 | 9/2012 | Anderson et al. | |
| 2002/0094914 | A1 | 7/2002 | Maresh et al. | |
| 2005/0049117 | A1 | 3/2005 | Rodgers et al. | |
| 2005/0181911 | A1* | 8/2005 | Porth | 482/52 |
| 2005/0202939 | A1* | 9/2005 | Lull et al. | 482/57 |
| 2005/0250621 | A1 | 11/2005 | Corbalis et al. | |
| 2005/0277516 | A1 | 12/2005 | Girard et al. | |
| 2007/0179023 | A1* | 8/2007 | Dyer | 482/52 |
| 2008/0242516 | A1 | 10/2008 | Lu et al. | |
| 2009/0156369 | A1 | 6/2009 | Rodgers, Jr. | |
| 2012/0058862 | A1 | 3/2012 | Anderson et al. | |
| 2012/0289380 | A1* | 11/2012 | Chen | 482/52 |

FOREIGN PATENT DOCUMENTS

| | | |
|---|---|---|
| DE | 2 225 342 | 5/1972 |
| DE | 24 08 052 | 2/1974 |
| DE | 4404831 | 12/1994 |
| GB | 1 169 148 | 10/1969 |
| GB | 1 326 263 | 8/1973 |
| GB | 1348716 | 3/1974 |
| GB | 1 505 702 | 3/1978 |
| GB | 2 120 560 | 12/1983 |
| JP | 56-56358 | 5/1981 |
| JP | 56-150562 | 11/1981 |

OTHER PUBLICATIONS

International Search Report and Written Opinion, PCT/US2014/013817, mailed May 21, 2014.

International Search Report and Written Opinion, PCT/US2014/013820, date of mailing May 12, 2014.

* cited by examiner

EXERCISE ASSEMBLIES HAVING FOOT PEDAL MEMBERS THAT ARE MOVABLE ALONG USER DEFINED PATHS

FIELD

The present disclosure relates to exercise assemblies.

BACKGROUND

U.S. Pat. No. 6,084,325, which is incorporated herein by reference in entirety discloses a resistance device with a combination of power-generating and eddy-current magnetic resistance having an outer fly wheel fastened on a central axle of a frame and fitted with a permanent magnet on the inner circular edge to form a rotor type, and the fly wheel is connected with a stator core fastened on the frame; moreover, one end of the central axle is stretching out of the frame and fitted with a belt wheel; the front end of the frame is fitted with a resistance device core adjacent to the outer edge of the fly wheel to supply a planned eddy current magnetic resistance to the fly wheel; in accordance with such design, the device generates power by means of the exercise force of users to drive the fly wheel to rotate, after passing through a DC power supply, it provides display & controlling gage with power source so that the power-generating and the eddy current magnetic resistance are integrated to reach the effect of reducing the volume and the producing cost.

U.S. Pat. No. 7,479,093, which is incorporated herein by reference in entirety discloses exercise apparatus having a pair of handles pivotally mounted on a frame and guiding respective user arm motions along swing paths obliquely approaching the sagittal plane of the user.

U.S. Pat. No. 7,625,317, which is incorporated herein by reference in entirety discloses exercise apparatus with a coupled mechanism providing coupled natural biomechanical three dimensional human motion.

U.S. Pat. No. 7,717,833, which is incorporated herein by reference in entirety discloses adjustable exercise machines, apparatuses, and systems. The disclosed machines, apparatuses, and systems typically include an adjustable, reversible mechanism that utilizes pivoting arms and a floating pulley. The disclosed machines, apparatuses, and systems typically are configured for performing, pushing and pulling exercises and may provide for converging and diverging motion.

U.S. Pat. No. 7,918,766, which is incorporated herein by reference in entirety discloses an exercise apparatus for providing elliptical foot motion that utilizes a pair of rocking links suspended from an upper portion of the apparatus frame permitting at least limited arcuate motion of the lower portions of the links. Foot pedal assemblies are connected to rotating shafts or members located on the lower portion of the links such that the foot pedals will describe a generally elliptical path in response to user foot motion on the pedals.

U.S. Pat. No. 7,931,566, which is incorporated herein by reference in entirety discloses exercise apparatus, which may be an elliptical cross trainer, having a rotating inertial flywheel driven by user-engaged linkage exercising a user. A user-actuated resistance device engages and stops rotation of the flywheel upon actuation by the user.

U.S. Pat. No. 8,272,997, which is incorporated herein by reference in entirety, discloses a dynamic link mechanism in an elliptical step exercise apparatus that can be used to vary the stride length of the machine. A control system can also be used to vary stride length as a function of various exercise and operating parameters such as speed and direction as well as varying stride length as a part of a preprogrammed exercise routine such as a hill or interval training program. In addition the control system can use measurements of stride length to optimize operation of the apparatus.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an exercise assembly comprises a frame; a pair of elongated foot pedal members, each foot pedal member having a front portion and a rear portion; a pair of foot pads, each foot pad being disposed on the rear portion of one of the pair of foot pedal members; a pair of elongated coupler arms, each coupler arm having a lower portion and having an upper portion that is pivotally connected to the frame; a pair of crank members, each crank member having a first portion that is pivotally connected to the front portion of one of the pair of foot pedal members and having a second portion that is pivotally connected to the lower portion of one of the pair of coupler arms, such that each crank member is rotatable in a circular path; and a pair of elongated rocker arms, each rocker arm having a lower portion that is pivotally connected to one of the pair of foot pedal members in between the foot pad and the crank member and having an upper portion that is pivotally connected to the frame. The pair of foot pedal members are each movable along user-defined paths of differing, dimensions.

In certain examples, a pair of elongated link members is also provided, each link member having a front portion and having a rear portion that is pivotally connected to one of the pair of rocker arms. A cross-link member is also provided, wherein the front portions of the link members are pivotally connected to opposite ends of the cross-link member. The cross-link member can be pivotally connected to the frame at a pivot axis extending between the link members. A front cross-shaft can also be provided that connects the upper portions of the pair of coupler arms to the frame. Timing belts can be connected to the second portion of one of the pair of crank members, such that movement of each of the pair of crank members along the circular path causes rotation of the respective timing belt. Each timing, belt can be connected to an opposite end of the front cross-shaft such that rotation of each timing belt causes rotation of the front cross-shaft. A resistance device can provide resistance on rotation of the front cross-shaft.

BRIEF DESCRIPTION OF THE DRAWINGS

Examples of exercise assemblies are described with reference to the following drawing figures. The same numbers are used throughout the drawing figures to reference like features and components.

DETAILED DESCRIPTION OF TUE DRAWINGS

In the present description, certain terms have been used for brevity, clearness, and understanding. No unnecessary limitations are to be inferred therefrom beyond the requirement of the prior an because such terms are used for descriptive purposes only and are intended to be broadly construed. The different assemblies described herein may be used alone or in combination with other apparatuses. Various equivalents, alternatives, and modifications are possible within the scope of the appended claims.

Figure 1:
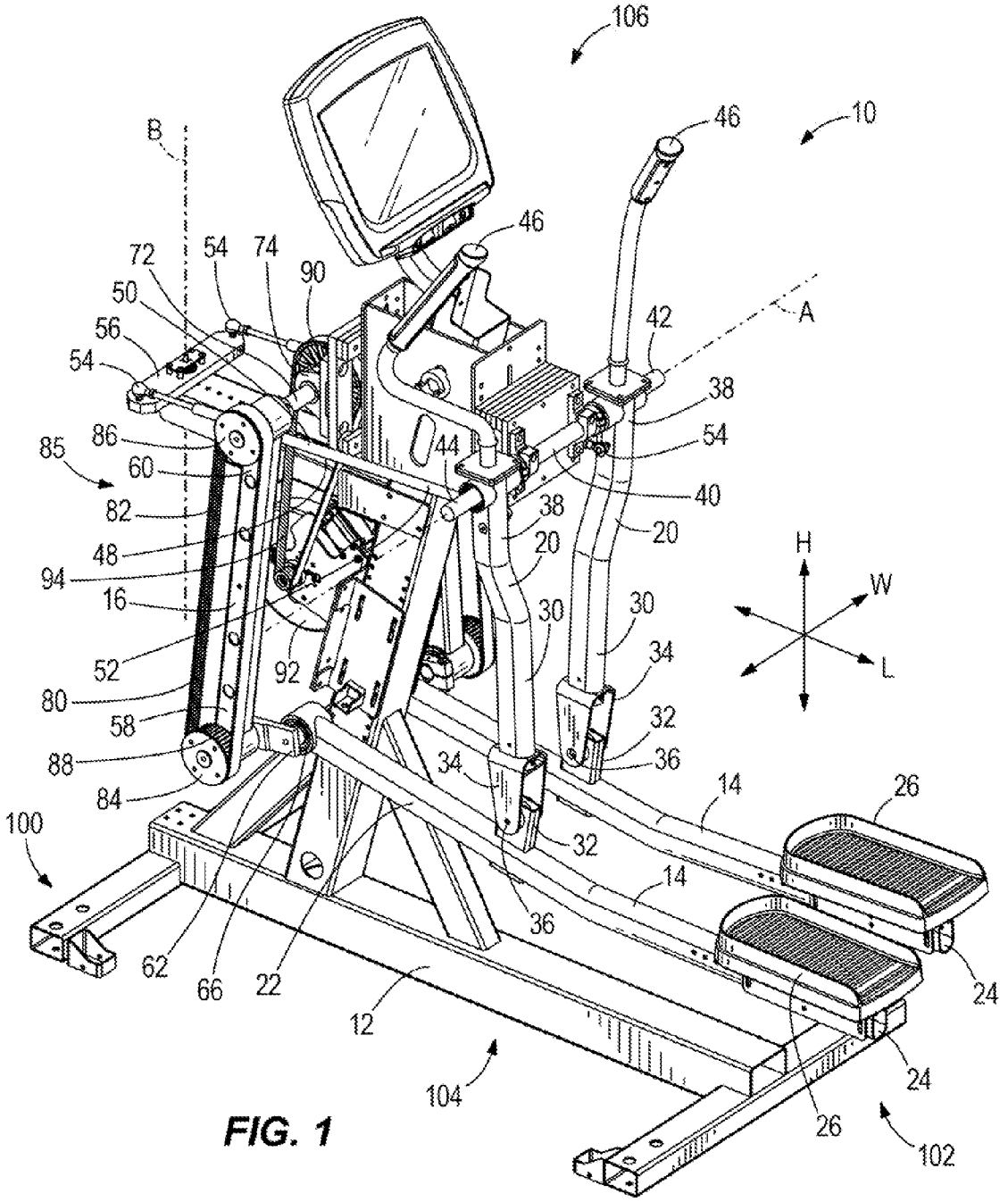
FIG. 1 is a perspective view of an exercise assembly.
Figure 2:
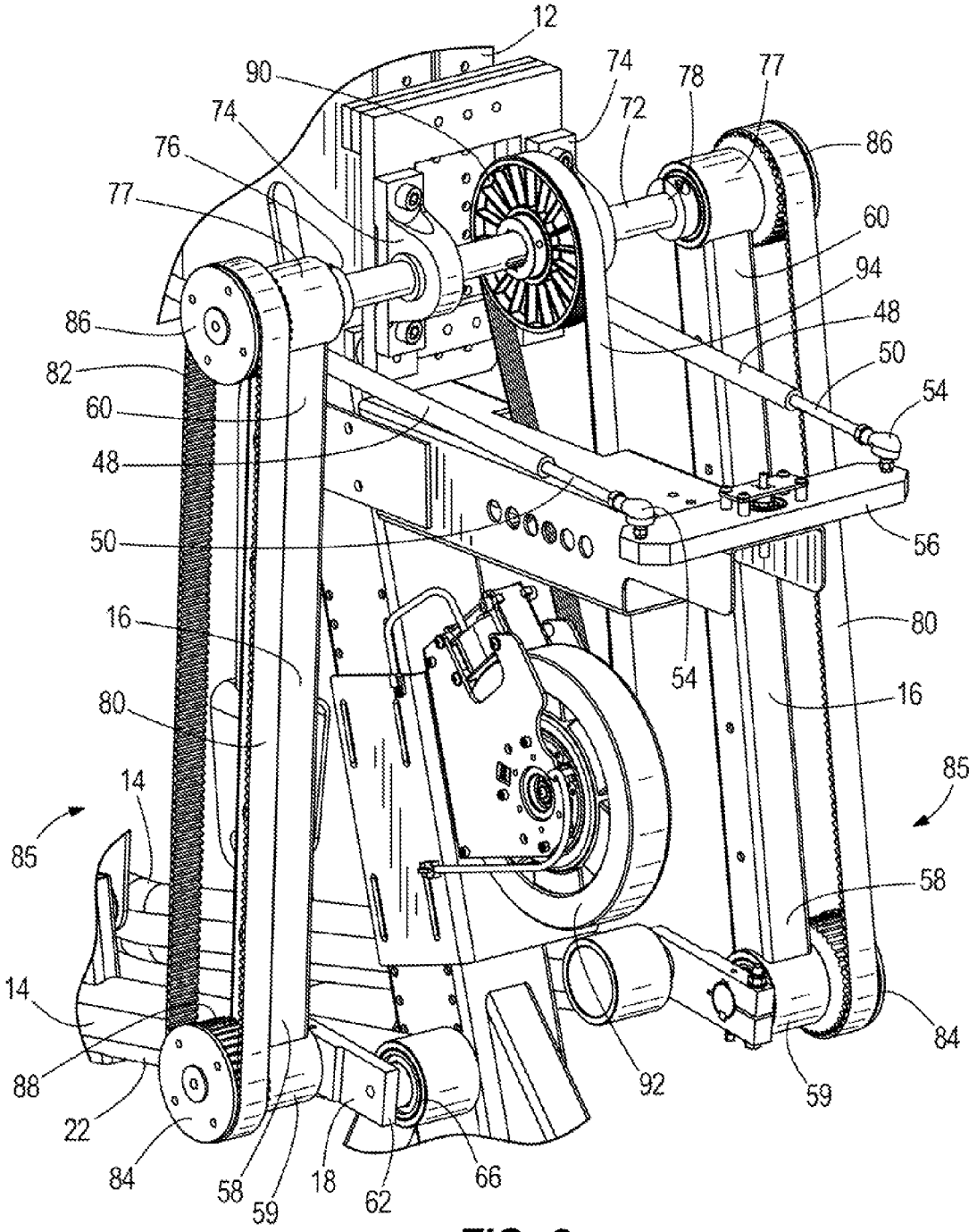
FIG. 2 is a closer view of a front portion of the exercise assembly.
Figure 3:
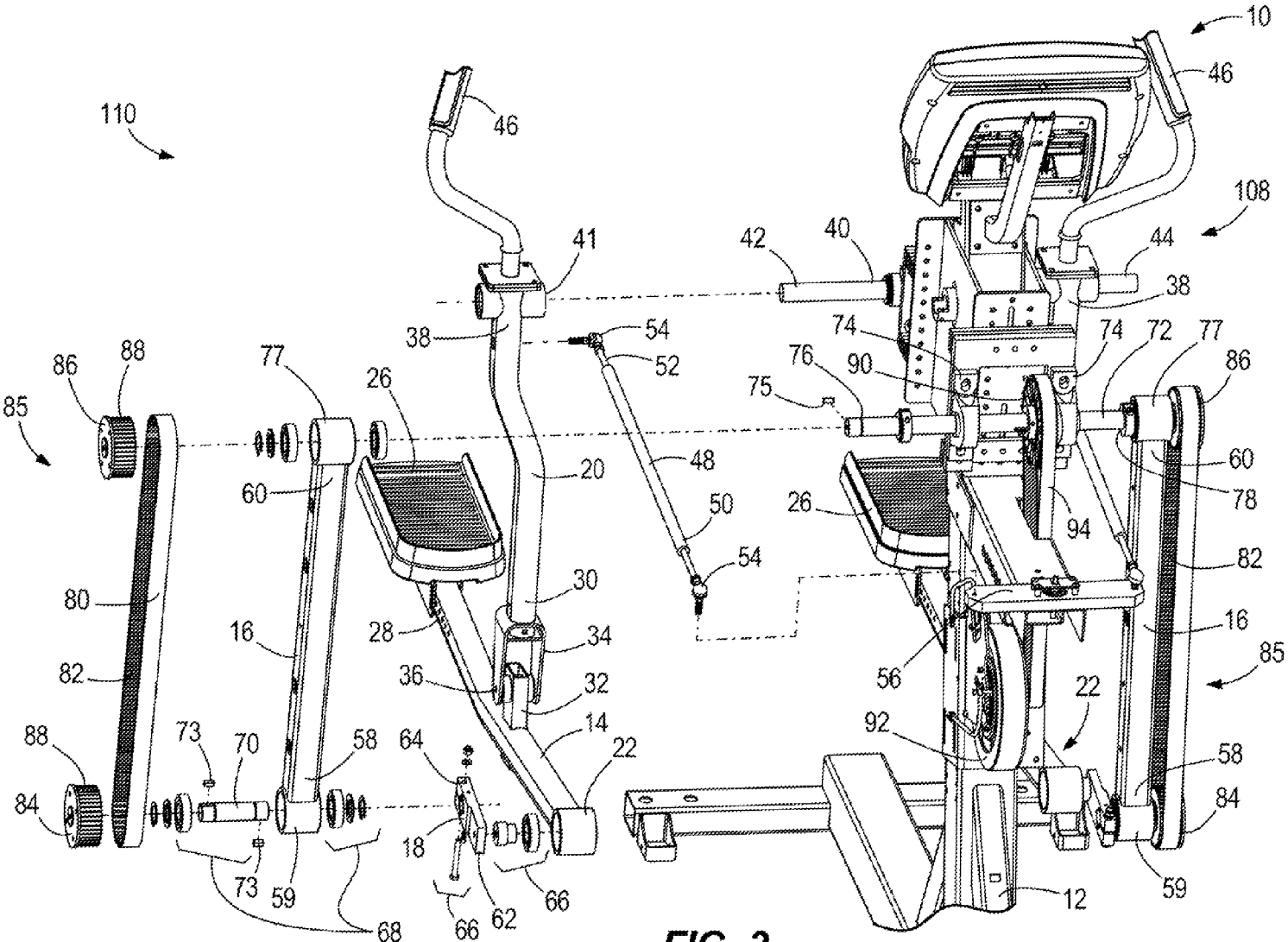
FIG. 3 is an exploded view of one side of the exercise assembly.

FIGS. 1-3 depict an exercise assembly 10 having a frame 12, a pair of elongated foot pedal members 14, a pair of elongated coupler arms 16, a pair of crank members 18 and a pair of elongated rocker arms 20. Each foot pedal member 14 has a front portion 22 and a rear portion 24. A pair of foot pads 26 is provided for supporting a user's feet. Each foot pad 26 is disposed on the rear portion 24 of one of the pair of foot pedal members 14. Each rocker arm 20 has a lower portion 30 that is pivotally connected to one Of the pair of foot pedal members 14 at a location that is between the foot pad 26 and the crank member 18. Any type of pivotal connection can be employed. In this example, an extension member 32 extends vertically upwardly from the foot pedal member 14 and pivotally connects a lower portion 30 of a rocker arm 20 to the foot pedal member 14. A U-shaped bracket 34 and a connecting pin 36 facilitate the connection such that the rocker anus 20 are pivotable with respect to the foot pedal members 14. Each extension member 32 extends upwardly from one of the respective pair of foot pedal members 14 and the U-shaped bracket 34 extends downwardly from the lower portion 30 of the respective rocker arms 20.

Each rocker arm 20 has an upper portion 38 that is directly or indirectly pivotally connected to the frame 12. The manner of connection to the frame 12 can vary. In this example, a rear cross-shaft 40 is secured to the frame 12 and has opposite ends 42, 44 on which the upper portions 38 of the rocker arms 20 are pivotally supported. In this example, the ends 42, 44 extend through respective bearings 41 in the rocker arms 20 to enable the freely rotatable, pivotable connection therewith. Thus, the pair of rocker arms 20 pivot about a common axis A, which extends through the rear cross-shaft 40.

A pair of handles 46 are disposed on the pair of rocker arms 20 and extend upwardly above the cross-shaft 40 such that movement of the handle 46 in a pivoting, rotational motion with respect to the axis A of the rear cross-shaft 40 causes similar, following pivoting, rotational motion of the lower portion 30 of the rocker arm 20.

Elongated link members 48 each have a front portion 50 and a rear portion 52. The rear portion 52 is pivotally connected to one of the pair of rocker arms 20. In this example, the connection between the rear portion 52 of the link member 48 and the rocker arm 20 is provided by a pivotal joint 54. A cross-link member 56 is pivotally connected to the frame 12 at a pivot axis B that extends between the link members 48. The front portions 50 of the link members 48 are pivotally connected to opposite ends of the cross-link member 56. In this example, the connection is made by pivotal joints 54. In this manner, the noted pivoting movement of each rocker arm 20 with respect to the axis A is translated to the other rocker arm 20 via the link members 48 acting on the opposite ends of the cross-link member 56, which in turn pivots about the noted pivot axis B.

The pair of coupler arms 16 each has a lower portion 58 and an upper portion 60. Each crank member 18 has a first end or portion 62 that is pivotally connected to the front portion 22 of one of the pair of foot pedal members 14 and also has a second end or portion 64 that is pivotally connected to the lower portion 58 of one of the pair of coupler arms 16. Connection of the first portion 62 of each crank member 18 is facilitated by a bearing and pin assembly 66 configured such that the crank member 18 freely rotates with respect to the foot pedal member 14. Connection of the second portion 64 of the crank member 18 to the lower portion 58 of the coupler arm 16 is facilitated by a bearing and through shaft assembly 68, wherein a through shaft 70 extends through a hub 59 in the lower portion 58 of the coupler arm 16 so that the coupler arm 16 can freely pivot with respect to the through shaft 70.

A front cross-shaft 72 is connected to the frame 12 by a pair of bearings 74. The front cross-shaft 72 has opposing, ends 76, 78 on which the upper portions 60 of the coupler arms 16 freely pivotally rotate. In this example, the front cross-shaft 72 effectively pivotally connects the upper portions 60 of the pair of coupler anus 16 to the frame 12 through bearings in hub 77 in the upper portions 60.

A pair of timing belts 80 having internal grooves 82 is connected at one end to the second portion 64 of the crank members 18 such that movement of the crank members 18 causes rotation of the respective timing belt 80, In this example, a pair of lower timing pulleys 84 is rotatably, fixedly connected to the crank members 18 via the bearing and through shaft assembly 68 such that rotation of the crank members 18 causes rotation of the lower timing pulleys 84. In this example, the fixed rotational connection is provided by locking keys 73. The timing belts 80 are fixedly, rotatably connected at their upper end to the opposing ends 76, 78 of the front cross-shaft 72 such that rotation of the timing belts 80 causes rotation of the front cross-shaft 72. Connection between the timing belts 80 and the front cross-shaft 72 is facilitated by a pair of upper timing pulleys 86. Upper timing pulleys 86 are connected to one end of the front cross-shaft 72 and transfer rotational movement of the respective timing belt 80 to the front cross-shaft 72. Each of the upper and lower timing pulleys 84, 86 have external ridges 88 that engage with the internal grooves 82 on the timing belts 80 to thereby transfer the noted rotation between the timing pulleys 84, 86 and timing belts 80. In this example, the fixed rotational connection between the timing pulleys 86 and front cross-shaft 72 is provided by locking keys 75.

A pulley 90 is rotationally fixed with and connected to a center portion of the front cross-shaft 72 such that rotation of the front cross-shaft 72 causes rotation of the pulley 90. A resistance device 92 is connected to the frame 12. The resistance device 92 can include one or more of any conventional resistance device, such as the resistance device having a combination of power generating and eddy current magnetic resistance disclosed in the incorporated U.S. Pat. No. 6,084,325. A pulley belt 94 connects the resistance device 92 to the pulley 90 such that rotation of the pulley 90 (which is caused by rotation of the front cross-shaft 72) is translated to the resistance device 92 by the pulley belt 94. In this example, the resistance device 92 generates power based upon rotation of the pulley 90.

It will thus be seen from drawing FIGS. 1-3 that the present disclosure provides an exercise assembly 10 that extends from a front end 100 to a back end 102 in a length direction L, from a lower end 104 to an upper end 106 in a height direction H that is perpendicular to the length direction L, and from a first side 108 to a second side 110 in a width direction W that is perpendicular to the height direction H and perpendicular to the length direction L. In these examples, the assembly 10 has the noted pair of elongated foot pedal members 14, each of which extend in the length direction L between the front portion 22 and rear portion 24. The pair of foot pads 26 is disposed on the rear portion 24 of one of the foot pedal members 14. The pair of elongated coupler arms 16 extends in the height direction H between a lower portion 58 and an upper portion 60. The pair of crank members 18 extend between the first portion 62 that is pivotally connected to the front portion 22 of one of the pair of foot pedal members 14 and the second portion 64 that is pivotally connected to the lower portion 58 of one of the coupler arms 16, such that each crank member 18 is rotatable in the circular path C (see FIG. 4) with respect to the coupler arm 16 and foot pedal member 14 when viewed from the first and second sides 108, 110. The pair of elongated rocker arms 20 each has the lower portion 30 that is pivotally connected to one of the pair of foot pedal members 14 in between the foot pad 26 and the crank member 18. As described further herein below, the pair of foot pedal members 14 are each movable along generally elliptical, vertical and horizontal paths of differing dimensions when viewed from the first and second sides 108, 110. The pair of elongated link members 48 extends in the length direction L between a front portion 50 and a rear portion 52 that is pivotally connected to one of the pair of rocker arms 20. The cross-link member 56 extends in the width direction W between opposite ends. The front portions 50 of the link members 48 are pivotally connected to one of the opposite ends of the cross-link member 56. The cross-link member 56 pivots about the axis B disposed between the pair of link members 48 in the width direction W.

Figure 4:
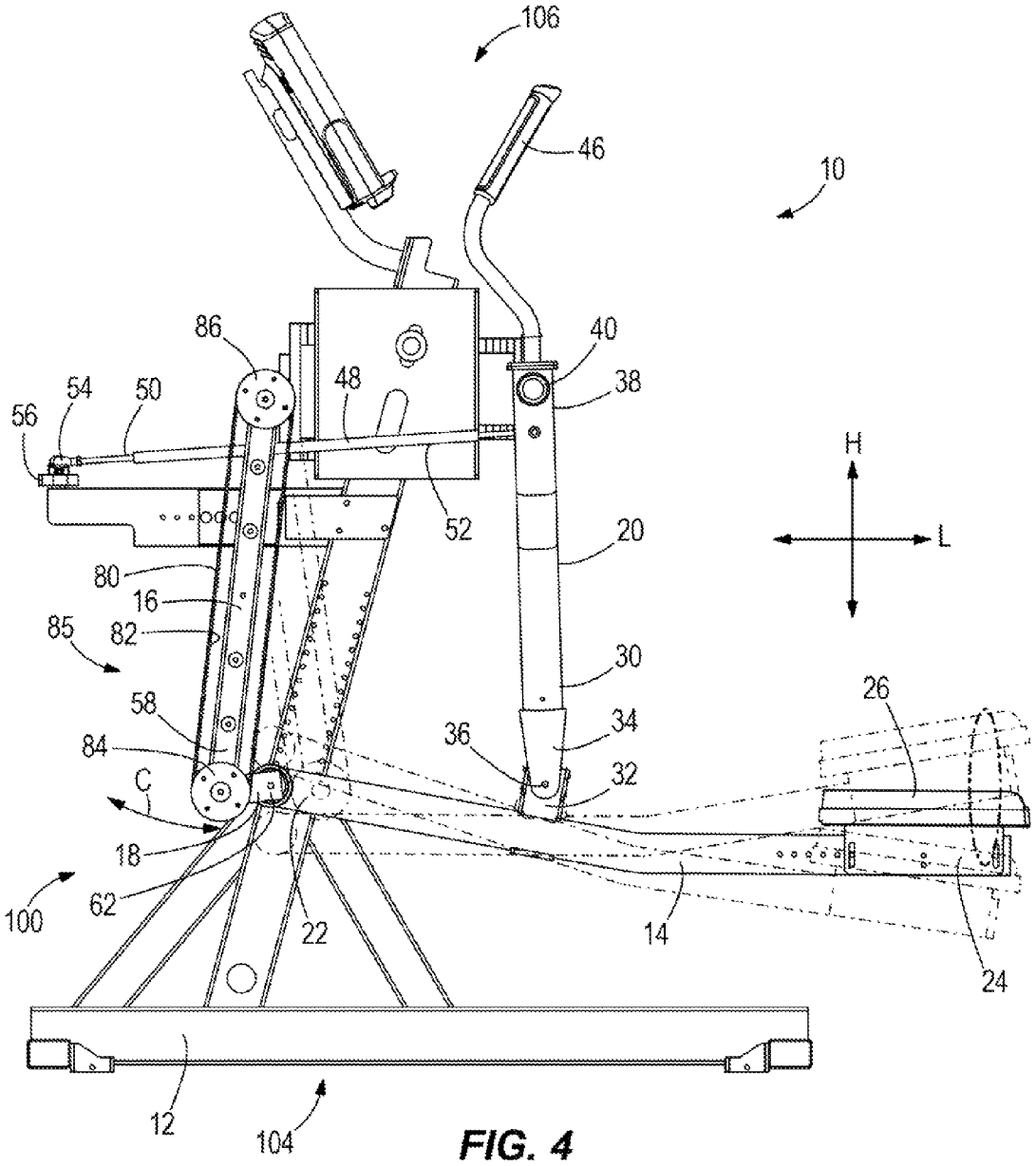
FIG. 4 is a side view of the assembly showing vertical stepping motion.
Figure 5:
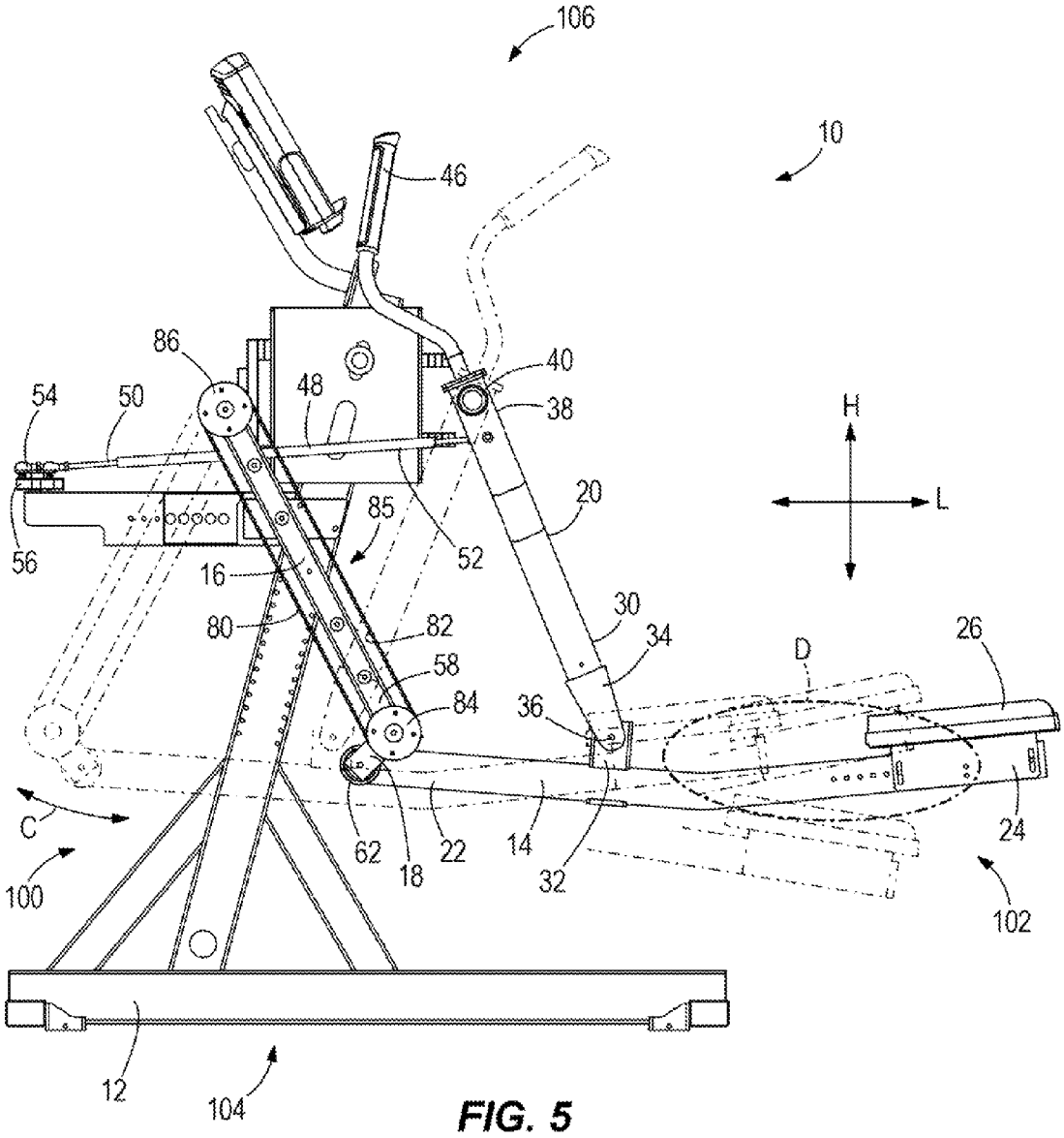
FIG. 5 is a side view of the assembly showing elliptical motion.

FIGS. 4 and 5 depict the exercise assembly 10 during certain exercise motions. In FIG. 4, the operator applies a generally vertical, up and down stepping motion onto the foot pads 26, which causes the foot pedal members 14 to vertically reciprocate as shown in phantom line in FIG. 4. Simultaneously, the user grasps the handles 46. The handles 46 can be maintained generally stationary with respect to the length direction L during vertical reciprocation of the foot pedal members 14. During the movements described above, the crank members 18 pivot in a generally circular path with respect to the foot pedal members 14 and coupler arms 16, as shown by the arrow C. The movement shown at line C can occur in both clockwise and counter-clockwise directions to exercise different muscle groups. During workout activities, the amount of operator hand motion on the handles 46 will help determine the shape of the path of the foot pedal members 14. The stride length of the path can be dynamically changed from short to long or from long to short.

FIG. 5 shows the assembly 10 during an extended stride exercise wherein the user applies movement as shown at line D to the foot pads 26 on the foot pedal members 14. The movement shown at line D can occur in both clockwise and counter-clockwise directions to exercise different muscle groups. The user also applies opposing, back and forth motions in the length direction L onto the handles 46. These motions cause the rocker arms 20 and coupler arms 16 to pivot about the respective cross-shafts 40, 72, as shown in phantom line in FIG. 5. Again, the crank members 18 rotate in a generally circular pathway as shown at arrow C.

The noted circular movement of the crank members 18 is transferred to the lower timing pulleys 84, timing belt 80, upper timing pulleys 86, front cross-shaft 72, pulley belt 94, and ultimately to the resistance device 92 for braking function and power generating, per the description in the incorporated U.S. Pat. No. 6,084,325.

As those having ordinary skill in the art would understand, the exercise assembly 10 thus facilitates a movement of the foot pedal members 14 along elliptical, vertical and horizontal paths of differing dimensions when viewed from the first and second sides 108, 110.

Figure 6:
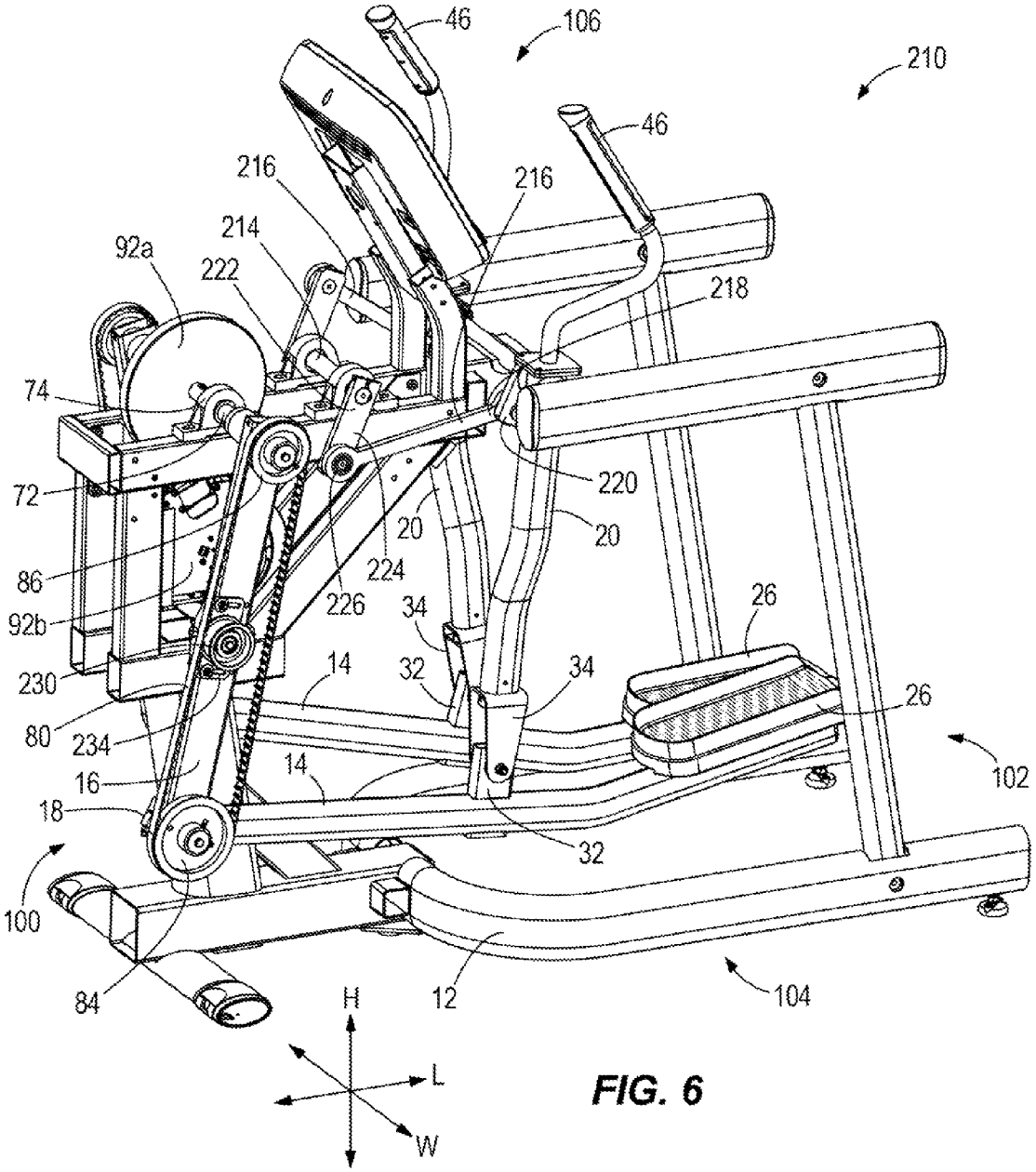
FIG. 6 is a perspective view of another embodiment of an exercise assembly.
Figure 7:
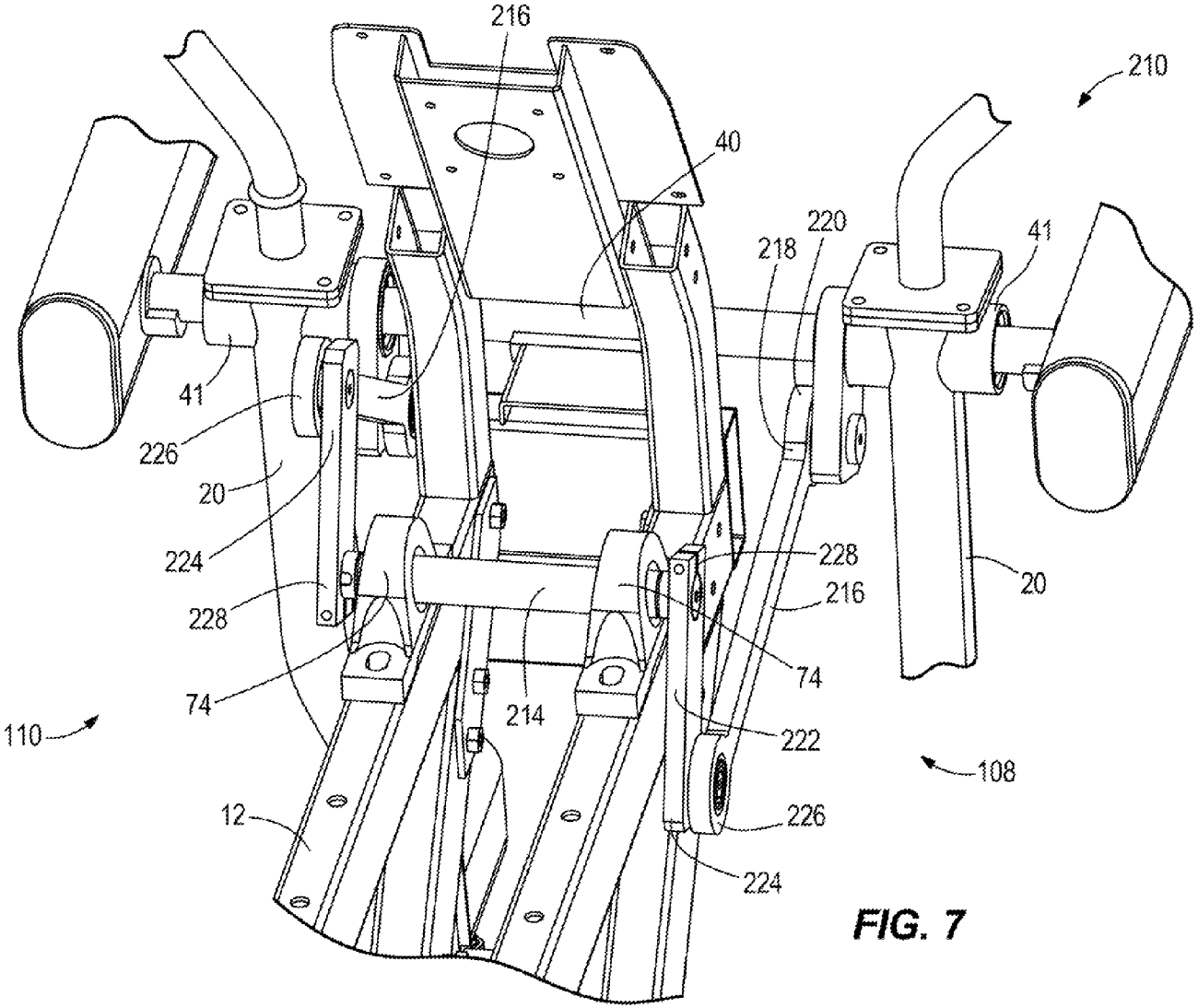
FIG. 7 is a closer view of a front portion of the exercise assembly shown in FIG. 6.
Figure 8:
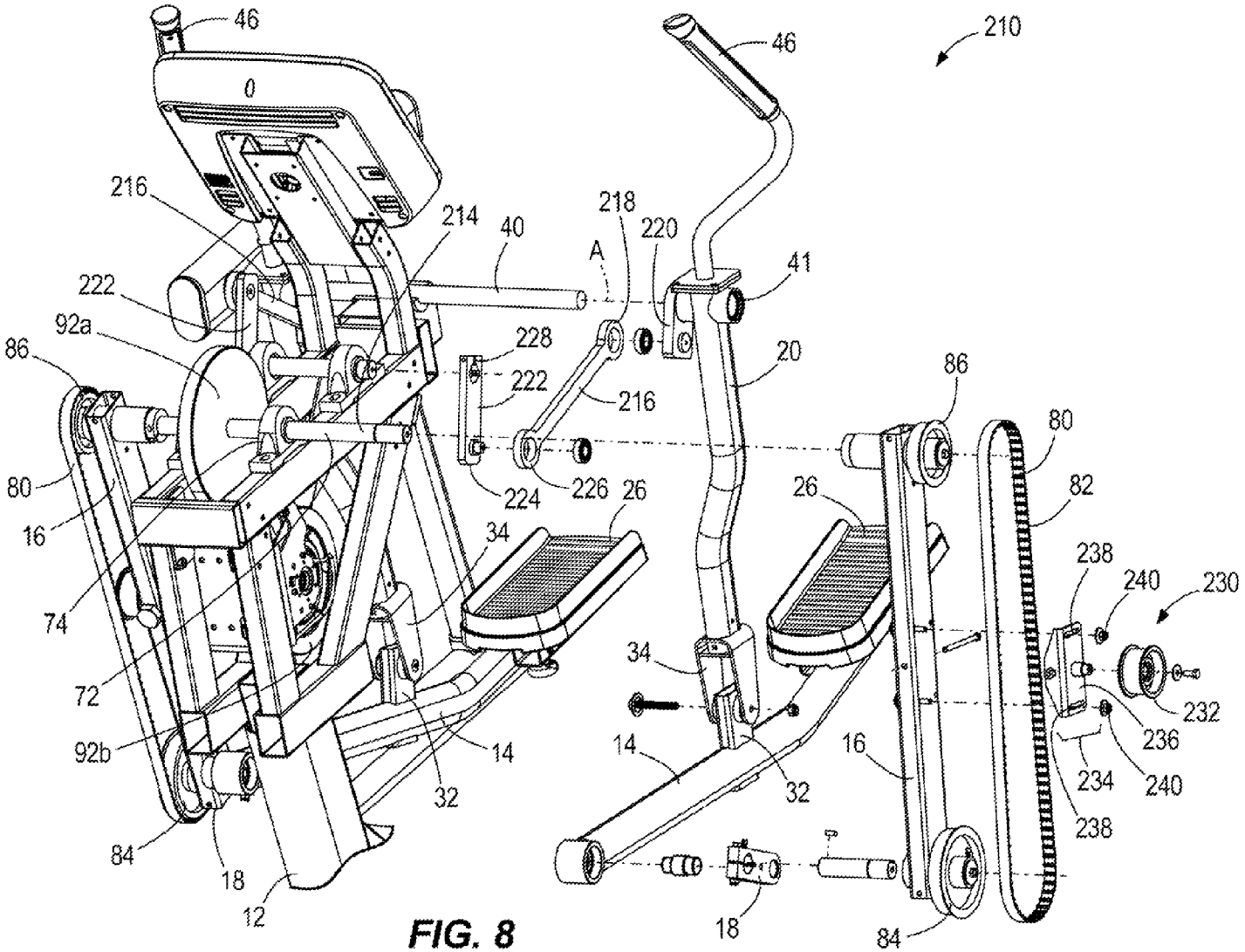
FIG. 8 is an exploded view of one side of the exercise assembly shown in FIG. 6.

FIGS. 6-8 depict another embodiment of an exercise assembly 210. The exercise assembly 210 has many features in common with or functionally similar to the exercise assembly 10 shown in FIGS. 1-5. Many of the features that are the same or similar in structure and/or function are given like reference numbers. However, all of the reference numbers provided in FIGS. 1-5 are not necessarily provided in FIGS. 6-8 to avoid clutter and maintain clarity of this description.

The exercise assembly 210 differs from the exercise assembly 10 in that it does not include the elongated link members 48, pivotal joints 54, and cross-link member 56. Instead, the exercise assembly 210 includes a cross-linking mechanism 212 that pivotally connects the pair of rocker arms 20 together such that movement of one of the pair of rocker arms 20 causes counteracting, opposite movement in the other of the pair of rocker arms 20. The cross-linking mechanism 212 includes a "four-bar mechanism" having a cross-linking shaft 214. A pair of first elongated link members 216 each have a rear portion 218 that is pivotally coupled to one of the pair of rocker arms 20. More specifically, the rear portions 218 are pivotally coupled to extension members 220 that are fixedly coupled to one of the pair of rocker arms 20. In this manner, the pair of first elongated link, members pivot with respect to the extension members 220, and thus with respect to the pair of rocker arms 20.

A pair of second elongated link members 222 each have a first portion 224 that is pivotally coupled to a front portion 226 of one of the pair of first elongated link members 216 and a second portion 228 that is fixedly coupled to the cross-linking shaft 214, such that rotation of one of the pair of second elongated link members 222 causes rotation of the cross-linking shaft 14 about its own axis, and rotation of the other of the pair of second elongated link members 222.

In this example, the respective pairs of first and second elongated link members 216, 222 are oppositely oriented with respect to each other and the cross-linking shaft 214. That is, as shown in FIG. 7, the first and second elongated link members 216, 222 on the first side 108 are vertically oriented downwardly, whereas the first and second elongated link members 216, 222 on the opposite, second side 110 are vertically oriented upwardly. The particular orientation of the respective link members 216, 222 can vary from that which is shown.

Movement of one of the pair of rocker an is 20 causes pivoting movement of one of the pair of first elongated link members 216 via the fixed extension member 220. Pivoting movement of the first elongated link member 216 causes pivoting movement of a corresponding one of the pair of second elongated link members 222. Pivoting movement of the second elongated link member 222 causes rotation of the cross-linking shaft 214 about its own axis, which is translated to the other of the pair of second elongated link members 222, which in turn causes pivoting movement of the other of the first elongated link member 216. Movement of the other of the first elongated link member 216 is translated to the other of the pair of rocker arms 20 via the extension member 220. Thus, the cross-linking mechanism 212 operably connects the pair of rocker arms 20 together.

The exercise assembly 210 shown in FIGS. 6-8 also differs from the exercise assembly 10 in that it includes a pair of belt tightening mechanisms 230 for adjusting tension in the pair of timing belts 80. Each pair of belt tightening mechanisms includes an idler wheel 232 that is coupled to one of the pair of coupler arms 16 by a joint 234. The joint 234 includes a plate 236 having at least one slot 238 that receives a fixing screw 240. The fixing screw can be fixed to the plate at different slot locations along the length of the slot 238 such that the idler wheel 232 is fixed at different locations with respect to the coupler arm 16. Adjusting the position of the idler wheel 232 transversely outwardly with respect to the elongated coupler arm 16 forces the outer radius of the idler wheel 232 against the internal grooves 82 on the timing belt 80, thus tensioning the timing belt 80. Opposite movement of the idler wheel 232 via the movable joint 234 releases tension on the timing belt 80.

The exercise assembly 210 shown in FIGS. 6-8 also differs from the exercise assembly 10 in that it includes a pair of resistance devices 92*a*, 92*b*, As discussed above, regarding the exercise assembly 10, the number and configuration of the resistance devices can vary.

What is claimed is:

1. An exercise assembly, the assembly comprising:

a frame;

a pair of elongated foot pedal members, each foot pedal member having a front portion and a rear portion;

a pair of foot pads, each foot pad being disposed on the rear portion of one of the pair of foot pedal members;

a pair of elongated coupler arms, each coupler arm having a lower portion and having an upper portion that is pivotally connected to the frame;

a pair of crank members, each crank member having a first portion that is pivotally connected to the front portion of one of the pair of foot pedal members and having a second portion that is pivotally connected to the lower portion of a respective one of the pair of coupler arms, such that each crank member is rotatable in a circular path about the lower portion of the respective one of the pair of coupler arms as the pair of elongated coupler arms pivot back and forth with respect to the frame; and a pair of elongated rocker arms, each rocker arm having a lower portion that is pivotally connected to one of the pair of foot pedal members in between the foot pad and the crank member and having an upper portion that is pivotally connected to the frame;

wherein the pair of foot pedal members are each movable along user defined paths of differing dimensions.

2. The assembly according to claim 1, further comprising a pair of handles, each handle disposed on one of the pair of rocker arms.

3. The assembly according to claim 2, wherein the upper portions of the pair of rocker arms pivot about a common axis.

4. The assembly according to claim 3, wherein the pair of rocker arms are pivotally connected to the frame via a rear cross-shaft.

5. The assembly according to claim 1, wherein the lower portion of one of the pair of rocker arms is pivotally attached to one of the pair of foot pedal members.

6. The assembly according to claim 1, comprising a pair of elongated link members, each link member having a front portion and haying a rear portion that is pivotally connected to one of the pair of rocker arms; and further comprising a cross-link member, wherein the front portions of the link members are pivotally connected to opposite ends of the cross-link member.

7. The assembly according to claim 6, wherein the cross-link member is pivotally connected to the frame at a pivot axis extending between the link members.

8. The assembly according to claim 7, comprising pivotal joints that connect the link members to the cross-link member.

9. The assembly according to claim 1, comprising a front cross-shaft that connects the upper portions of the pair of coupler arms to the frame.

10. An exercise assembly, the assembly comprising:

a frame;

a pair of elongated foot pedal members, each foot pedal member having a front portion and a rear portion;

a pair of foot pads, each foot pad being disposed on the rear portion of one of the pair of foot pedal members;

a pair of elongated coupler arms, each coupler arm having a lower portion and having an upper portion that is pivotally connected to the frame;

a pair of crank members, each crank member having a first portion that is pivotally connected to the front portion of one of the pair of foot pedal members and having a second portion that is pivotally connected to the lower portion of one of the pair of coupler arms, such that each crank member is rotatable in a circular path, and a pair of elongated rocker arms. each rocker arm having a lower portion that is pivotally connected to one of the pair of foot pedal members in between the foot pad and the crank member and having an upper portion that is pivotally connected to the frame;

wherein the pair of foot pedal members are each movable alone user defined paths of differing dimensions a front cross-shaft that connects the upper portions of the pair of coupler arms to the frame; and a pair of timing belts, each timing belt being connected to the second portion of one of the pair of crank members, such that movement of each of the pair of crank members along the circular path causes rotation of the respective timing belt.

11. The assembly according to claim 10, comprising a pair of lower timing pulleys, each lower timing pulleys being connected to one of the pair of crank members and transferring rotational movement of the respective crank member to the timing belt.

12. The assembly according to claim 10, wherein each timing belt is connected to an opposite end of the front cross-shaft such that rotation of each timing belt causes rotation of the front cross-shaft.

13. The assembly according to claim 12, comprising a pair of upper timing pulleys, each upper timing pulley being connected to one end of the front cross-shaft and transferring rotational movement of a respective timing belt to the front cross-shaft.

14. The assembly according to claim 12, comprising a pulley connected to the front cross-shaft; wherein rotation of the front cross-shaft causes rotation of the pulley.

15. The assembly according to claim 14, comprising a resistance device being connected to the pulley and providing resistance on rotation of the front cross-shaft.

16. The assembly according to claim 15, comprising a pulley belt that connects the resistance device to the pulley; wherein rotation of the pulley is translated to the resistance device by the pulley belt.

17. The assembly according to claim 16, wherein the resistance device generates power based upon rotation of the pulley.

18. The assembly according to claim 10, comprising a pair of belt tightening mechanisms for adjusting tension in the pair of timing belts.

19. The assembly according to claim 18, wherein each of the pair of belt tightening mechanisms comprises an idler wheel that is coupled to one of the pair of coupler arms by a joint that allows the idler wheel to be fixed at different locations with respect to the coupler arm; wherein fixing the idler wheel at a different location with respect to the coupler arm adjusts the tension.

20. The assembly according to claim 19, wherein the movable joint comprises a plate having at least one slot that receives a fixing screw at different slot locations.

21. The assembly according to claim 1, comprising a cross-linking mechanism that pivotally connects the pair of rocker arms together.

22. An exercise assembly, the assembly comprising:

a frame;

a pair of elongated foot pedal members, each foot pedal member having a front portion and a rear portion;

a pair of foot pads, each foot pad being disposed on the rear portion of one of the pair of foot pedal members;

a pair of elongated coupler arms, each coupler arm having a lower portion and having an upper portion that is pivotally connected to the frame;

a pair of crank members, each crank member having a first portion that is pivotally connected to the front portion of one of the pair of foot pedal members and having a second portion that is pivotally connected to the lower portion of one of the pair of coupler arms, such that each crank member is rotatable in a circular path; and a pair of elongated rocker arms, each rocker arm having a lower portion that is pivotally connected to one of the pair of foot pedal members in between the foot pad and the crank member and having an upper portion that is pivotally connected to the frame;

wherein the pair of foot pedal members are each movable along user defined paths of differing dimensions, wherein the cross-linking mechanism comprises a cross-linking mechanism that pivotally connects the pair of rocker arms together;

a cross-linking shaft;

a pair of first elongated link members that each have a rear portion that is pivotally coupled to one of the pair of rocker arms; and a pair of second elongated link members that each have a first portion that is pivotally coupled to a front portion of one of the pair of first elongated link members and a second portion that is fixedly coupled to the cross-linking shaft such that rotation of one of the pair of second elongated link members causes rotation of the cross-linking shaft and the other of the pair of second elongated link members.

23. The assembly according to claim 22, comprising extension members that are fixedly coupled to one of the pair of rocker arms and that are pivotably coupled to the rear portion of one of the pair of first elongated link members, such that the pair of first elongated link members pivot with respect to the pair of rocker arms.

24. An exercise assembly, the assembly comprising:

a frame;

a pair of elongated foot pedal members, each foot pedal member having a front portion and a rear portion;

a pair of foot pads, each foot pad being disposed on the rear portion of one of the pair of foot pedal members;

a pair of elongated coupler arms, each coupler arm having a lower portion and having an upper portion that is pivotally connected to the frame;

a pair of crank members, each crank member having a first portion that is pivotally connected to the front portion of one of the pair of foot pedal members and having a second portion that is pivotally connected to the lower portion of one of the pair of coupler arms, such that each crank member is rotatable in a circular path;

a pair of elongated rocker arms, each rocker arm having a lower portion that is pivotally connected to one of the pair of foot pedal members in between the foot pad and the crank member and having an upper portion that is pivotally connected to the frame;

wherein the pair of foot pedal members are each movable along paths of differing dimensions, respectively;

a front cross-shaft that connects the upper portions of the pair of coupler arms to the frame;

a pair of timing belts, each timing belt being connected to the second portion of one of the pair of crank members, such that movement of each of the pair of crank members along the circular path causes rotation of the respective timing belt;

wherein each timing belt is connected to an opposite end of the front cross-shaft such that rotation of each timing belt causes rotation of the front cross-shaft; and a resistance device providing resistance on rotation of the front cross-shaft.

25. An exercise assembly having a front end and a back end, said assembly extending between said front end and said back end in a length direction, from a lower end to an upper end in a height direction that is perpendicular to the length direction; and from a first side to a second side in a width direction that is perpendicular to the height direction and perpendicular to the length direction; the assembly comprising:

a pair of elongated foot pedal members, each foot pedal member extending in the length direction between a front portion and a rear portion;

a pair of foot pads, each foot pad being disposed on the rear portion of one of the pair of foot pedal member;

a pair of elongated coupler arms, each coupler arm extending in the height direction between a lower portion and an upper portion;

a pair of crank members, each crank member extending between a first portion that is pivotally connected to the from portion of one of the pair of foot pedal members and a second portion that is pivotally connected to the lower portion of a respective one of the pair of coupler arms, such that each crank member is rotatable in a circular path about the lower portion of the respective one of the pair of coupler arms as the pair of elongated coupler arms pivot back and forth with respect to the frame, when viewed from the first and second sides; and a pair of elongated rocker arms, each rocker arm having a lower portion that is pivotally connected to one of the pair of foot pedal members in between the foot pad and the crank member;

wherein the pair of foot pedal members are each movable along user defined paths when viewed from the first and second sides.

26. The assembly according to claim 25, comprising a pair of elongated link members, each link member extending in the length direction between a front portion and a rear portion that is pivotally connected to one of the pair of rocker arms; and further comprising a cross-link member extending in the width direction between opposite ends, wherein the front portions of the link members are pivotally connected to one of the opposite ends, respectively, of the cross-link member; wherein the cross-link member pivots about a pivot, axis extending between the pair of link members.

27. An exercise assembly having a front end and a back end, said assembly extending between said front end and said back end in a length direction, from a lower end to an upper end in a height direction that is perpendicular to the length direction; and from a first side to a second side in a width direction that is perpendicular to the height direction and perpendicular to the length direction; the assembly comprising:

a pair of elongated foot pedal members, each foot pedal member extending in the length direction between a front portion and a rear portion;

a pair of foot pads, each foot pad being disposed on the rear portion of one of the pair of foot pedal members;

a pair of elongated coupler arms, each coupler arm extending in the height direction between a lower portion and an upper portion;

a pair of crank members, each crank member extending between a first portion that is a pivotally connected to the front portion of one of the pair of foot pedal members and a second portion that is pivotally connected to the lower portion of one of the pair of coupler arms, such that each crank member is rotatable in a circular path when viewed from the first and second sides; and a pair of elongated rocker arms, each rocker arm having a lower portion that is pivotally connected to one of the pair of foot pedal members in between the foot pad and the crank member;

wherein the pair of foot pedal members are each movable along user defined paths when viewed from the first and second sides; and comprising a pair of timing belts, each timing belt being connected to the second portion of one of the pair of crank members, such that movement of each crank member along the circular path causes rotation of a respective timing belt.

28. The assembly according to claim 27, wherein each timing belt is connected to one end of the front cross-shaft such that rotation of the timing belt causes rotation of the front cross-shaft.

29. The assembly according to claim 28, comprising a pulley connected to the front cross-shaft; wherein rotation of the front cross-shaft causes rotation of the pulley.

30. The assembly according to claim 29, comprising a resistance device that provides resistance on rotation of the front cross-shaft.

31. The assembly according to claim 30, comprising a pulley belt that connects the resistance device to the pulley; wherein rotation of the pulley is translated to the resistance device.

* * * * *

UNITED STATES PATENT AND TRADEMARK OFFICE

CERTIFICATE OF CORRECTION

PATENT NO. : 9,050,498 B2
APPLICATION NO. : 13/783610
DATED : June 9, 2015
INVENTOR(S) : Zhi Lu et al.

It is certified that error appears in the above-identified patent and that said Letters Patent is hereby corrected as shown below:

In the Claims,

In claim 6, at column 7, line 63, “haying” should instead read --having--.

In claim 10, at column 8, line 26, delete the “.” between “arms” and “each” and substitute a --,--.

In claim 10, at column 8, line 33, “alone” should instead read --along--.

Signed and Sealed this
Twenty-second Day of September, 2015

Michelle K. Lee

Michelle K. Lee
*Director of the United States Patent and Trademark Office*